US008106568B2

(12) United States Patent
Kao et al.

(10) Patent No.: US 8,106,568 B2
(45) Date of Patent: Jan. 31, 2012

(54) LIGHTING DEVICE CAPABLE OF SUPPRESSING OCCURRENCE OF OVELAP OF MULTIPLE SHADES

(76) Inventors: Hsueh-Chung Kao, Tainan (TW); Chao-Jen Wang, Tainan Hsien (TW)

( * ) Notice: Subject to any disclaimer, the term of this patent is extended or adjusted under 35 U.S.C. 154(b) by 188 days.

(21) Appl. No.: 12/402,511

(22) Filed: Mar. 12, 2009

(65) Prior Publication Data

US 2009/0230833 A1 Sep. 17, 2009

(30) Foreign Application Priority Data

Mar. 14, 2008 (TW) ..... 97108954 A

(51) Int. Cl.
*H05B 33/02* (2006.01)
*F21V 3/04* (2006.01)

(52) U.S. Cl. ..... 313/46; 313/511; 313/512; 362/516

(58) Field of Classification Search ..... None
See application file for complete search history.

(56) References Cited

U.S. PATENT DOCUMENTS 6,657,382 B2 * 12/2003 Nagai et al. ..... 313/512
2004/0239243 A1 * 12/2004 Roberts et al. ..... 313/512
2005/0169006 A1 * 8/2005 Wang et al. ..... 362/555
2005/0185419 A1 * 8/2005 Holman et al. ..... 362/561
2005/0207165 A1 * 9/2005 Shimizu et al. ..... 362/362
2007/0217193 A1 * 9/2007 Lin et al. ..... 362/245
2007/0242461 A1 * 10/2007 Reisenauer et al. ..... 362/294
2007/0247873 A1 * 10/2007 Awai et al. ..... 362/618
2007/0297178 A1 * 12/2007 Tain et al. ..... 362/294
2008/0238323 A1 * 10/2008 Chan et al. ..... 315/35

* cited by examiner

*Primary Examiner* — Anne Hines
*Assistant Examiner* — Tracie Green
(74) *Attorney, Agent, or Firm* — Leong C. Lei

(57) ABSTRACT

Disclosed is an assembly of light-emitting units, which is applicable to a lighting device that comprises a plurality of light-emitting elements respectively mounted to heat dissipation units. The light-emitting elements give off light beams that project outward through a light-transmitting hood. One surface of the light-transmitting hood is provided with a light diffusion layer featuring light refraction. As such, the light beams emitting from the light-emitting elements are made converging on a light incidence area, which, together with the feature of light spreading of the light-transmitting hood, can spread off and thus homogenize the light beams to form a surface source, and can also concentrate the light energy of the lighting device to enhance the brightness. The lighting device can be applied to any lighting facility.

8 Claims, 9 Drawing Sheets

LIGHTING DEVICE CAPABLE OF SUPPRESSING OCCURRENCE OF OVELAP OF MULTIPLE SHADES

TECHNICAL FIELD OF THE INVENTION

The present invention generally relates to an assembly of light-emitting units, and particularly to a light-emitting structure applicable to any lighting unit or facility, in such a way that light beams from a plurality of light-emitting elements converging at a light incidence area, together with the features of diffusion and homogenization of light of a light-transmitting hood, makes it possible to realize concentration of light sources to enhance the brightness of the lighting device and also to effectively homogenize lighting provided by multiple light beams, as well as effective in suppressing the generation of overlap of multiple shades.

DESCRIPTION OF THE PRIOR ART

Lighting and illuminating units that are commonly used in daily living includes the traditional tungsten filament based incandescent lamp bulbs, elongate bar like mercury-containing fluorescent tubes, and spiral or multiple-U-shaped power-saving bulbs. These known lighting units each show very limited average lighting energy for each unit area; and most of the glass enclosures are coated with fluorescent powders containing mercury, or alternatively, sand blasting is applied to make a frosted light-diffusion layer that has an irregular surface, so as to make light uniformly project outward through the enclosure. In this way, when a user stares at the light source, the user perceive a softened feeling, the eyes are not irritated, and no dazzling to the eyes occurs. With the light emission surface of the light source being strongly homogenized, when the light source is shaped as a sphere, a bar, or a U-shaped rod, the homogenized outward-projecting light does not easily causes a significant shadow of an irradiated object, and such a insignificant shade may often be ignored by a user, if the user does not pay particular attention to it. Thus, the shade generally causes no interference with the user's eye sight. However, due to the current trend of environmental protection and conservation of power, the above discussed lighting elements are to be replaced and banned for future use.

A next-generation and environment-protecting lighting element is a light-emitting diode, which, however, provides only a point source of light. This makes the use of the light-emitting diode inconvenient and shows no mature commercialization. Further, a single light-emitting diode does not provide an illumination that is as high as the conventional lighting units, so that it often need to combine multiple light-emitting diodes together as a single lighting device by which total illumination can be enhanced with the large number of light-emitting diodes used together and the minimum requirement of lighting regulation can be met.

In an arrangement of combining a plurality of lighting elements having substantially the same lighting power, since the locations of adjacent lighting elements are extremely close and the elements have substantially the same brightness, a phenomena of "shade overlap" often occurs, which may easily interfere with the user's eyesight, deteriorating the concentration of the user and causing fatigue of eyes. In view of these problems, the present invention aims to provide a lighting arrangement that effectively overcome the drawbacks of the conventional devices.

SUMMARY OF THE INVENTION

To realize the objective of overcoming the drawbacks of the conventional devices, an assembly of lighting units is provided in accordance with the present invention, which is applicable to a lighting device, which features enhancement of the overall brightness and elimination of dazzling by providing a light-transmitting hood below the lighting elements.

The present invention relates to an assembly of light units, which is applicable to a lighting device comprising a plurality of light-emitting elements that are mounted respectively to heat dissipation units. The light-emitting elements project light beams outward through a light-transmitting hood, wherein the light-transmitting hood is made of a material having excellent light transmittance and has a surface on which a light diffusion layer featuring light refraction is provided. As such, with a plurality of point light sources giving off light beams that are converted into light that is in the form of a surface light source for projecting outward, the phenomena of overlap of multiple shades is overcome and light energy of the lighting device can be properly concentrated to enhance the brightness. The lighting device can be applied to various lighting facility and has the advantage of being practical.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figures 1, 2:
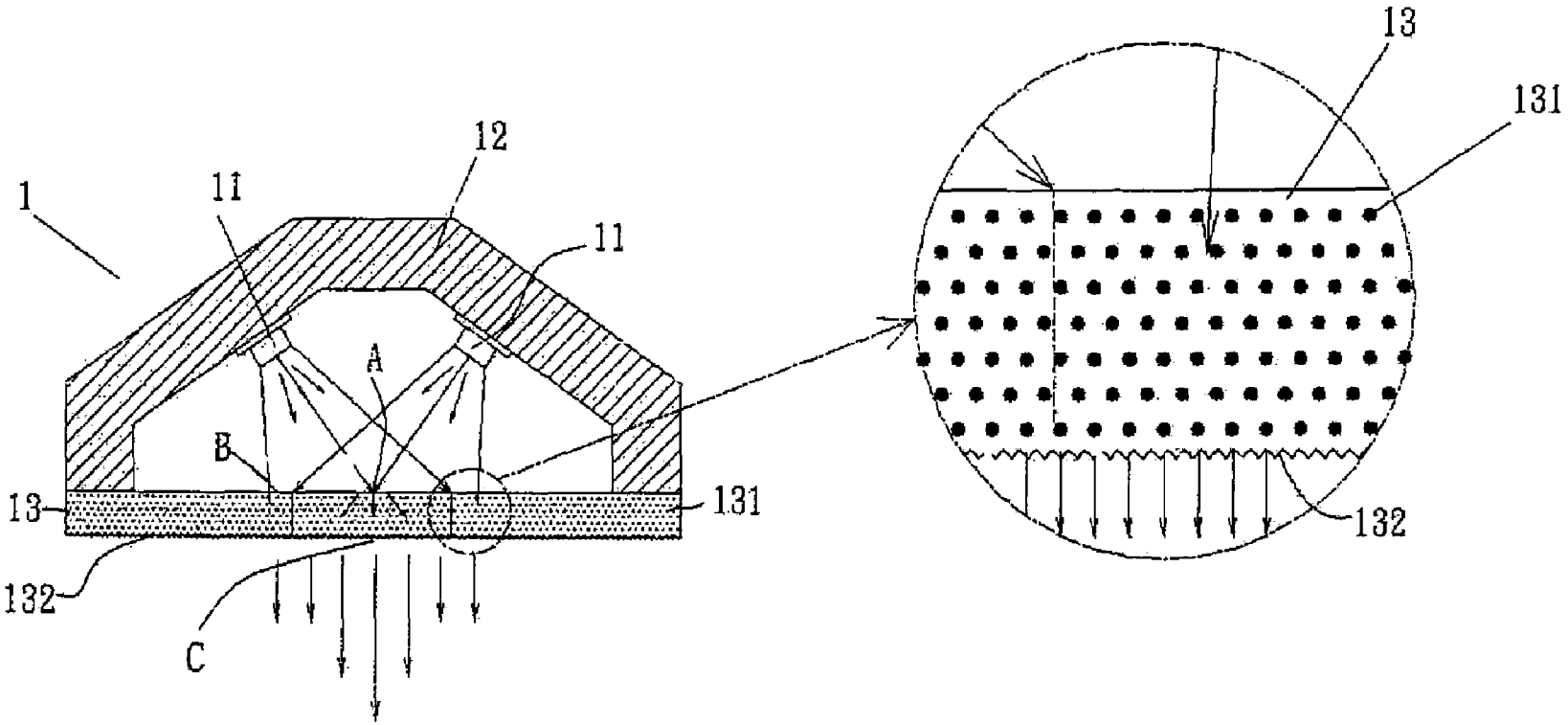
FIG. 1 shows a schematic cross-sectional view of the present invention.
FIG. 2 shows a partial enlarged view of the present invention.

With reference to the drawings and in particular to FIG. 1, which shows a schematic cross-sectional view of the present invention, a lighting device 1 comprises a plurality of light-emitting elements 11, a heat dissipation unit 12, and a light-transmitting hood 13.

The plurality of light-emitting elements 11 is arranged at different angles inside the lighting device 1 and may project light beams that converge at an incidence focusing spot A and jointly covers a light incidence area B.

The heat dissipation unit 12 provides a heat dissipative structure to which the plurality of light-emitting elements 11 is mounted and functions to dissipate and transmit waste heat of high temperature generated by the light-emitting elements 11.

The light-transmitting hood 13 comprises a hood that set at a light-radiated location below the plurality of light-emitting elements 11 (and may comprise of a material containing diffusive particles 131) and that has a surface on which a light diffusion layer 132 featuring light refraction, diffraction, and homogenization is mounted.

For an arrangement of mounting multiple light-emitting elements 11 (two light-emitting elements 11 being taken as an illustrative example in the instant, first embodiment and the light-emitting elements 11 being light-emitting diodes in the embodiment) on a single one heat dissipation unit 12, the heat dissipation unit 12 is provided with two parts orientating different angles to fix the light-emitting elements 11 respectively. Light beams emitted from the two light-emitting elements 11 (as indicated by arrows) converge at the incidence focusing spot A and the two light beams jointly form the light incidence area B. The light beams on the incidence focusing spot A and the light incidence area B are radiating correspondingly on the light-transmitting hood 13 and are then projecting outward therethrough. With the feature of the light-transmitting hood 13 comprising a material that contains the diffusive particles 131 therein, the light beams can be spread off in the direction where the light beams travel forward (this being the preferred embodiment). Or alternatively, when the light beams transmit through the surface of the light-transmitting hood 13, the light beams may be refracted by the light diffusion layer 132 mounted on the surface of the light-transmitting hood 13, whereby conversion of the light sources from being of multiple directions of projection into a surface-source like light exit area C that is more straightforward-directed can be realized at the time when the light beams project through the light-transmitting hood, with a major lighting spot having the highest light energy density being located exactly below the incidence focusing spot A (lengths of arrows indicating levels of light energy density), and opposite sides or surrounding area around the major lighting spot being secondary lighting zone having reduced light energy density of which secondary shade overlap can be suppressed by the high intensity of the major lighting spot and thus become not so clear. With such a mechanism, a user's perception can be deceived.

Also referring to FIG. 2, which shows a partial enlarged view of the present invention, incident light sources originate from the emission of the plurality of light-emitting elements and the traveling directions of the light beams from the light sources vary in accordance with the arranged orientations of the light-emitting elements. When light beams projecting in different directions radiate the same opaque object, shades extending from the opaque object in different directions corresponding to the projection directions of the light beams are generated; closely located light-emitting element radiating lights on opaque objects that are adjacent to each other may generate shades that overlap each other. To overcome such an optic phenomena, the light-transmitting hood 13 is structured to modify the projection direction when the light transmits therethrough, so as to eliminate the secondary shade overlap. For situations where sufficient luminous flux and budgets are available, the light-transmitting hood 13 can be structured to contain the diffusive particles 131 therein, whereby refraction, reflection, and diffraction of light induced when the light radiates the diffusive particles 131 can break up the traveling direction of the light and afterwards, a micro-structure formed on a light exiting surface of the light diffusion layer 132 may cause multiple-angle refraction and diffraction of the light to homogenize the light and make the contour of shade unclear and un-sharp. In case of insufficiency of luminous flux and budget, the light-transmitting hood 13 is only constructed to comprise the micro-structure of the light exiting surface and with such a structure, the light diffusion layer 132 may change the traveling direction of light to cause homogenous diffraction of light, making the light energy that is projected through a light exit zone homogenous in the projection direction.

Figure 3:
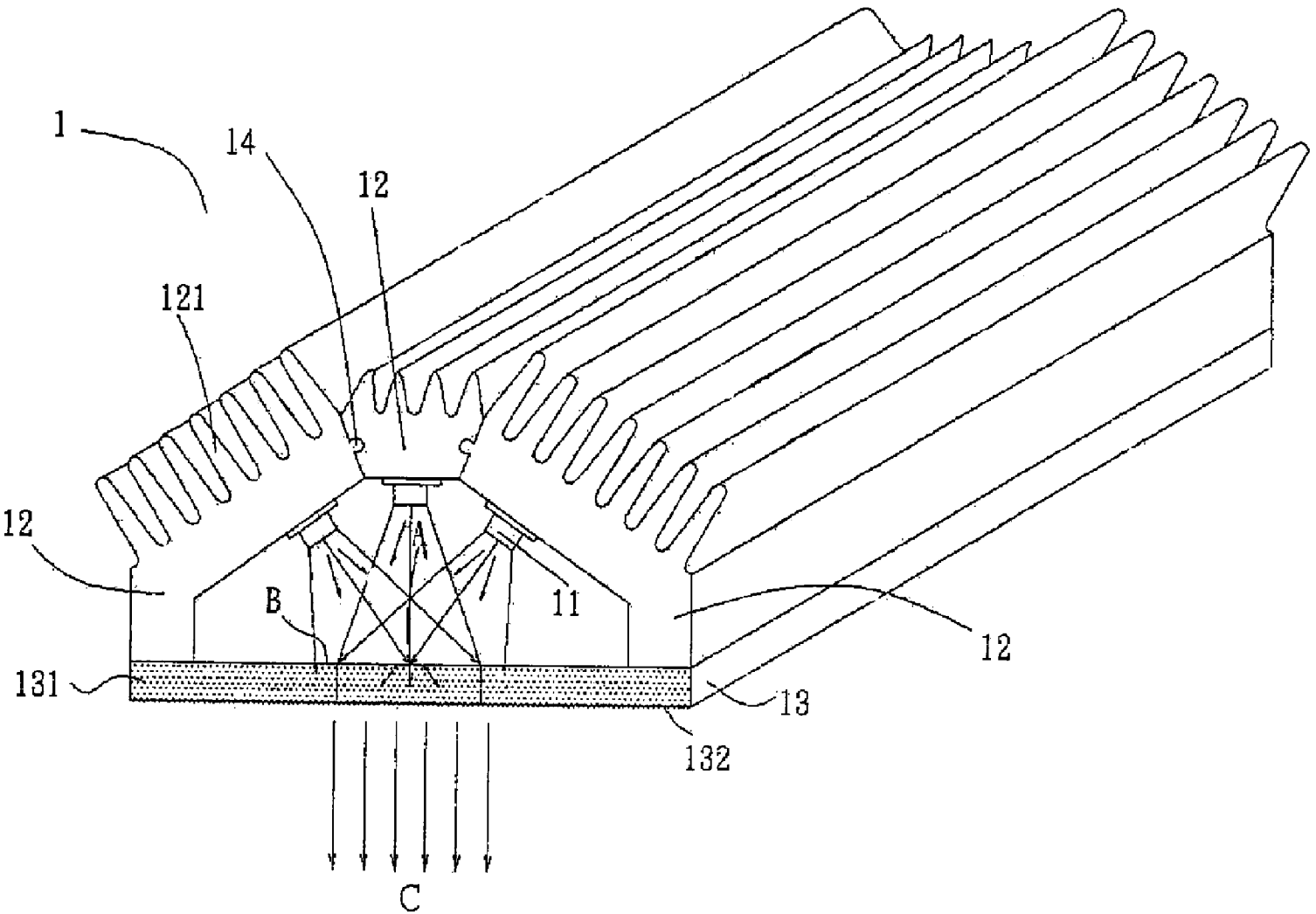
FIG. 3 illustrates a first example embodiment of a heat dissipation unit in accordance with the present invention.

Also referring to FIG. 3, which illustrates a first example embodiment of the heat dissipation unit in accordance with the present invention, the heat dissipation unit 12 of the present invention can be constructed as a single unitary heat dissipation unit 12 corresponding to and supporting multiple light-emitting elements 11, or alternatively, a single lighting device 1 can be provided with a plurality of heat dissipation units 12, for example more than one heat dissipation unit 12, as shown in FIG. 3, wherein three heat dissipation units 12 are each provided with a light-emitting element 11. Each heat dissipation unit 12 is constructed to form heat dissipation fins 121 extending therefrom for dissipating away the heat generated by the light-emitting element 11 thereby realizing heat dissipation. The light beams emitting from the light-emitting elements 11 of the three units converge at an incidence focusing spot A, forming a single overlapping high-intensity zone, while every two of the light beams may are combine with each other to form a Light incidence area B having a low light intensity. The light beams on the incidence focusing spot A and the light incidence area B are radiating correspondingly on the light-transmitting hood 13 and are then projecting outward therethrough. Due to the feature of the light-transmitting hood 13 comprising a material that contains the diffusive particles 131 therein, the light beams can be spread off in the direction where the light beams travel forward (the diffusive particles 131 being omittable for the consideration of excessive expense). Further, when the light beams transmit through the surface of the light-transmitting hood 13, the light beams may be refracted by the light diffusion layer 132 mounted on the surface of the light-transmitting hood 13 for energy dispersion of the light beams, whereby conversion of the light sources from being of multiple directions of projection into a surface-source like light exit area C can be realized at the time when the light beams project through the light-transmitting hood.

Figure 4:
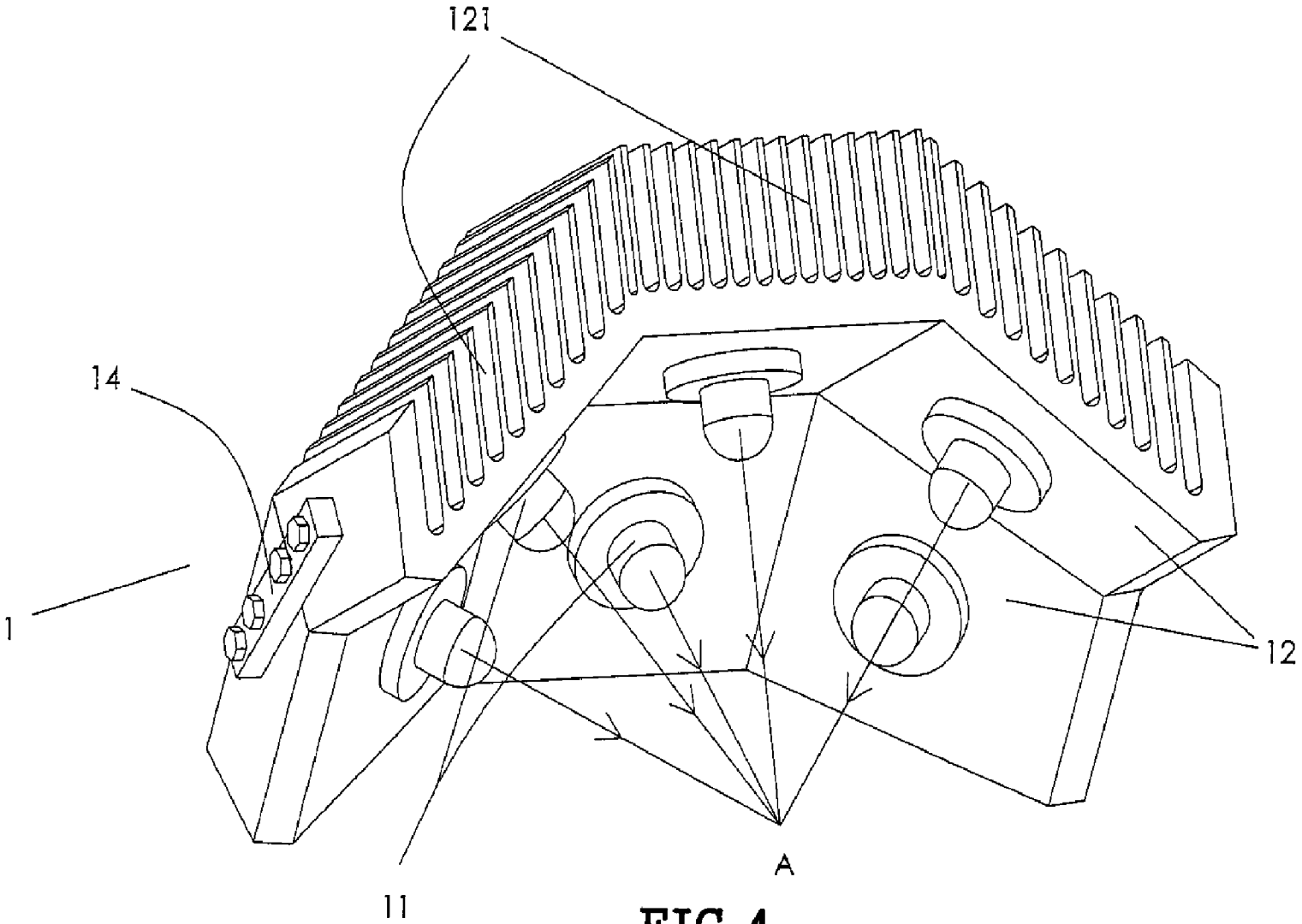
FIG. 4 illustrates a second example embodiment of the heat dissipation unit in accordance with the present invention.

Referring to FIG. 4, which illustrates a second example embodiment of the heat dissipation unit in accordance with the present invention, the heat dissipation unit 1 of the present invention may be formed of an assembly of more than one heat dissipation element 12 and in the instant embodiment, two heat dissipation elements 12 are each comprised of three light-emitting elements 11. The three light-emitting elements 11 are arranged at corresponding angles and mounted to the corresponding heat dissipation element 12 in such a way that central axis of the light beams from the three light-emitting elements 11 intersect at an incidence focusing spot A. The two heat dissipation elements 12 are respectively set at the desired angles and fixed together to form a common incidence focusing spot A. With such an arrangement, multiple light beams can converge at a single primary light energy intensified zone and a large number of heat dissipation fins 121 are provided to realize heat exchange between the waste heat generated by the multiple light-emitting elements 11 and cold air, by which heat dissipation is realized.

Figure 5:
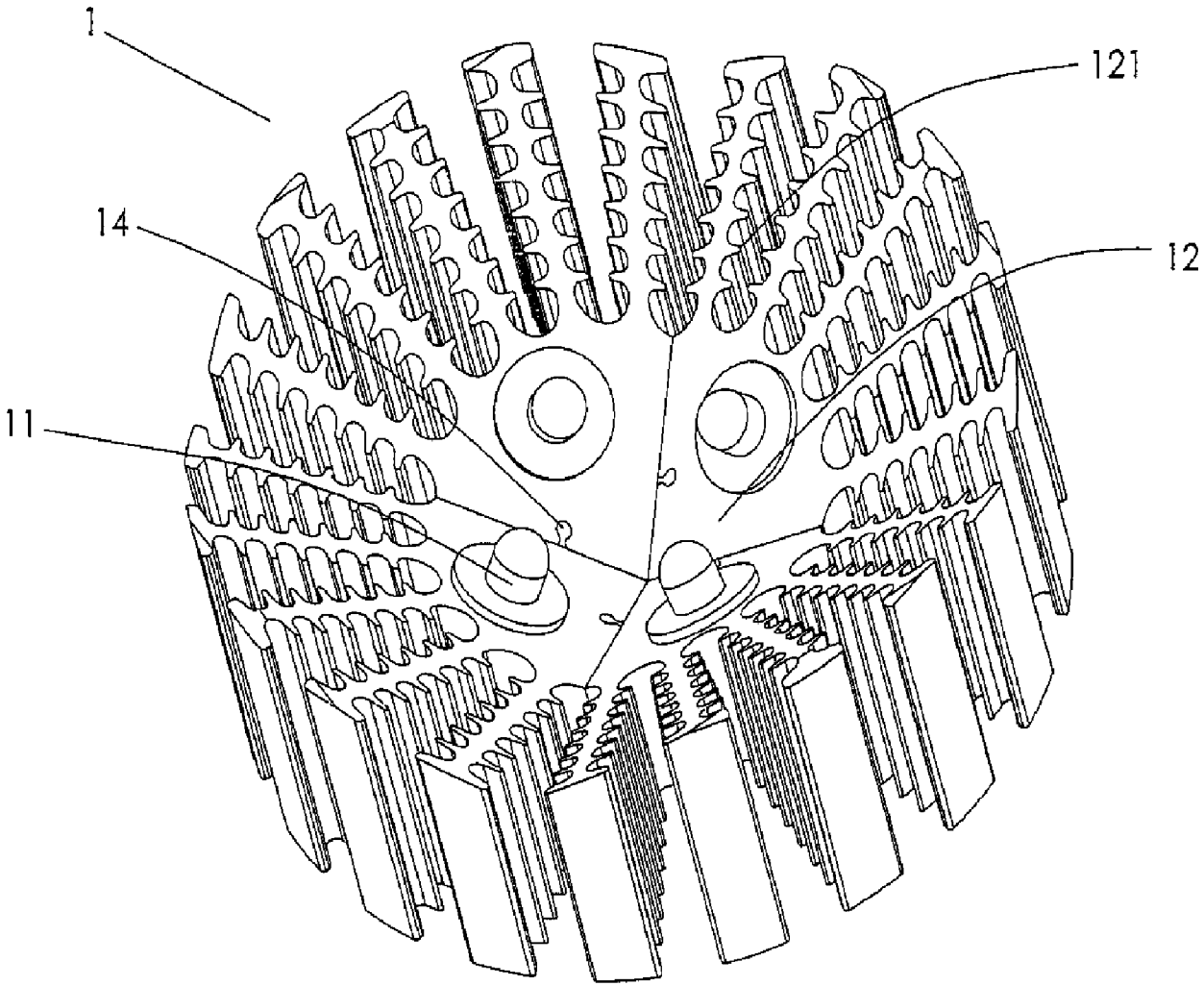
FIG. 5 illustrates a third example embodiment of the heat dissipation unit in accordance with the present invention.

Referring to FIG. 5, which illustrates a third example embodiment of the heat dissipation unit in accordance with the present invention, the heat dissipation unit 1 of the present invention may be formed of four individual heat dissipation elements 12, which are butted and jointed to each other by being arranged at corresponding angles and each coupled to a respective light-emitting element 11 and fixed together by fastening sections 14 to form a complete heat dissipation unit 1. The center of the light beam emitting from each individual light-emitting element 11 is aimed at a respective predetermined orientation. Heat dissipation fins 121 extending from each individual heat dissipation element 12 realize heat exchange between a huge amount of waste heat generated by the multiple light-emitting elements 11 and cold air, by which heat dissipation is realized.

Figure 6:
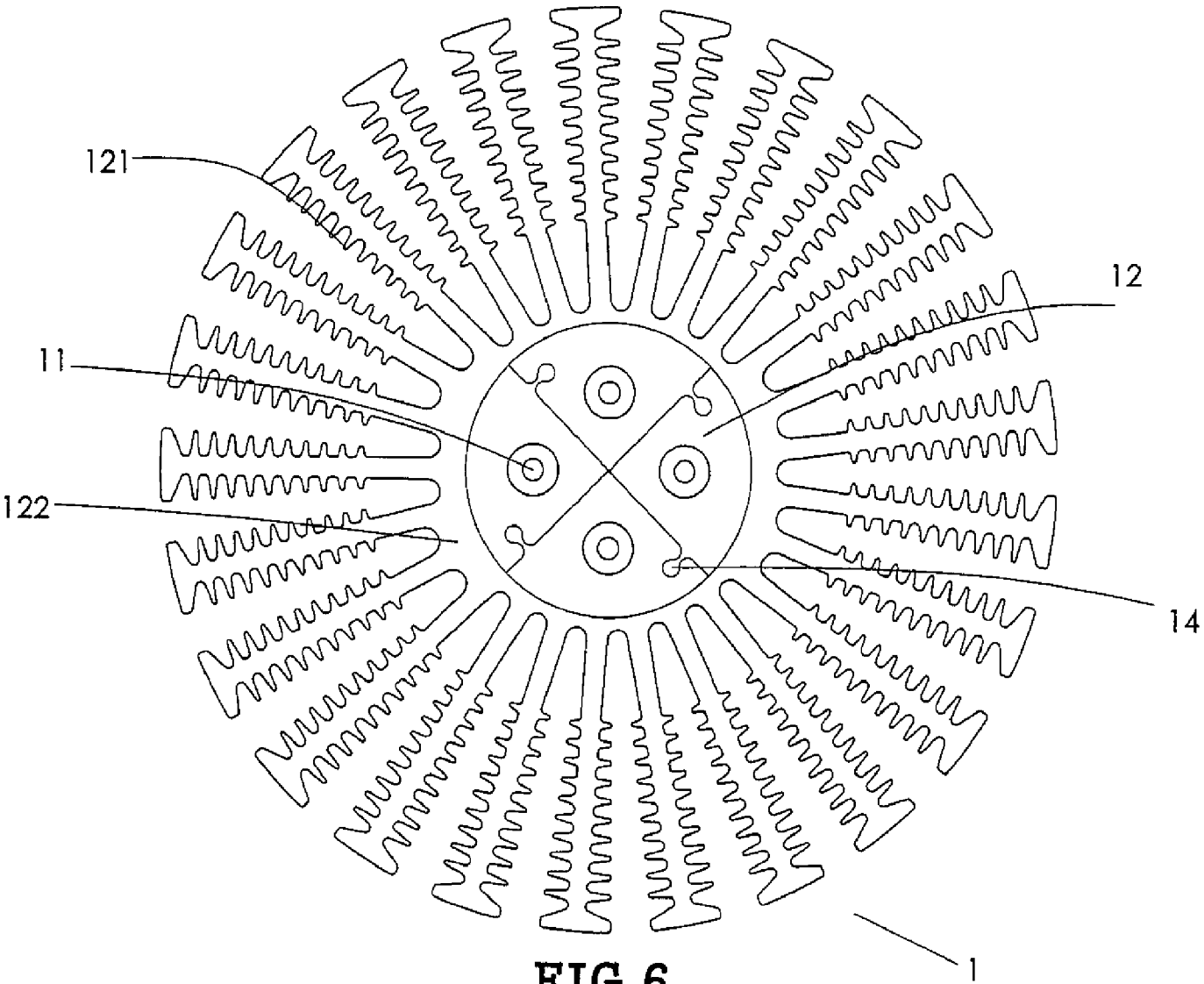
FIG. 6 illustrates a fourth example embodiment of the heat dissipation unit in accordance with the present invention.

Referring to FIG. 6, which illustrates a fourth example embodiment of the heat dissipation unit in accordance with the present invention, the heat dissipation unit 1 of the present invention is formed of a plurality of heat dissipation elements 12, so that when each individual or a combination of the heat dissipation elements 12 is incapable of effectively remove the heat generated by multiple light-emitting elements 11, the heat dissipation elements 12 are coupled together with fastening sections 14 and an enhanced heat dissipater 122 is additionally provided at a suitable location to assist removal of heat. Further, the enhanced heat dissipater 122 can form heat dissipation fins 121 in the form of a fish-bone arrangement to dissipate off the high temperature induced by the light-emitting elements 11 thereby realizing effective heat dissipation for maintaining life span for the light-emitting elements 11.

Figure 7:
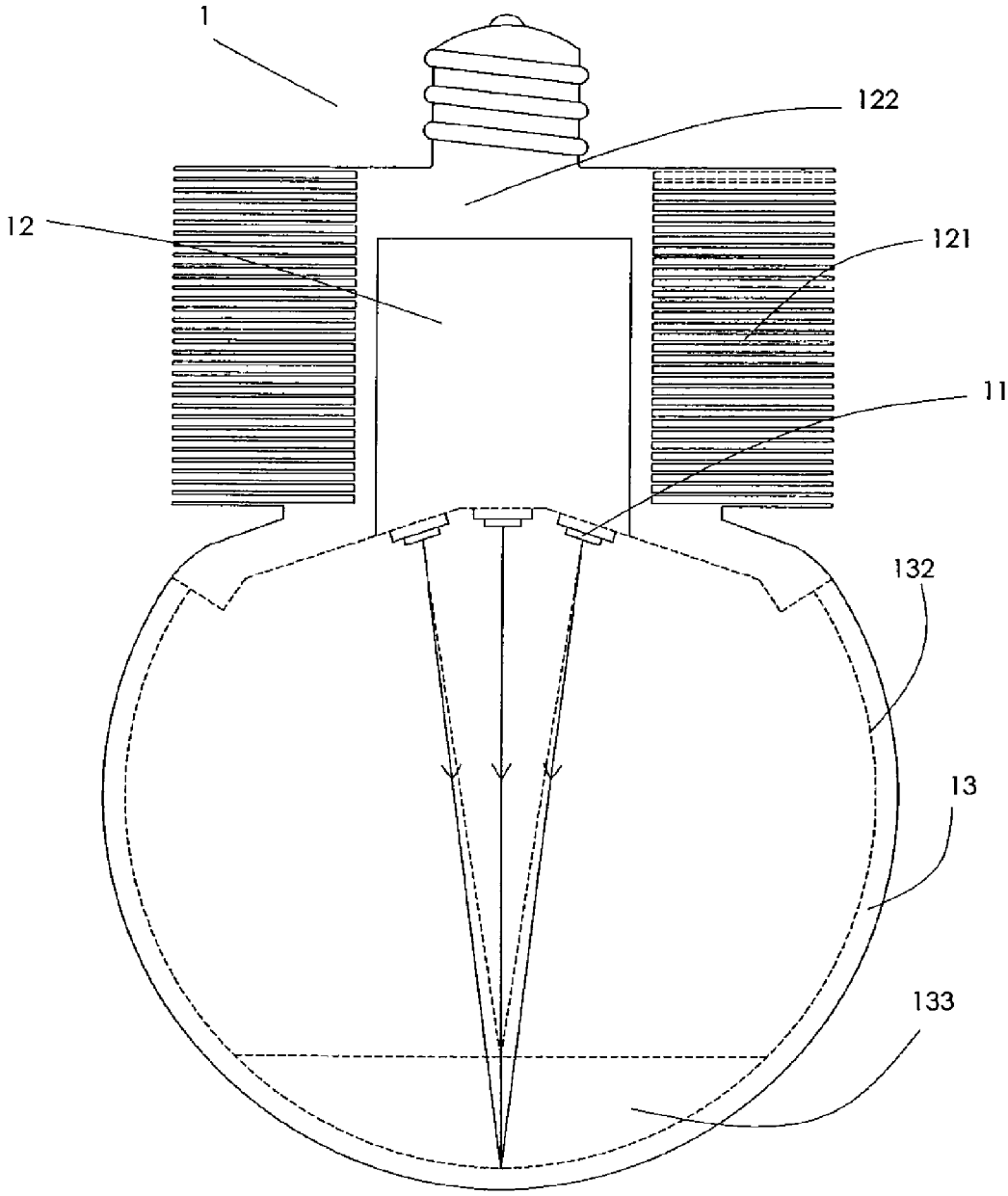
FIG. 7 illustrates a first example application of the present invention.

Referring to FIG. 7, which illustrates a first example application of the present invention, a lighting device 1 can be applied to the above discussed lighting device or a light bulb, wherein a plurality of light-emitting elements 11 is mounted to a single heat dissipation unit 12 and the heat dissipation unit 12 is provided with an enhanced heat dissipater 122, which is comprised of a plurality of heat dissipation fins 121 for assisting the heat dissipation unit 12 to remove heat. Light beams emitting from the plurality of light-emitting elements 11 project through the light-transmitting hood 13 that is spherical in the instant embodiment to form a spherical light source. The light-transmitting hood 13 can be a hood of a uniform thickness or a hood comprising a convex lens 133. In an attempt to replace a concentrated light source with the hood comprising the convex lens 133, the angles at which the light-emitting elements 11 are respectively set must be properly adjusted (as indicated by phantom lines) to have the centers of the light beams converge at a spot.

Figure 8:
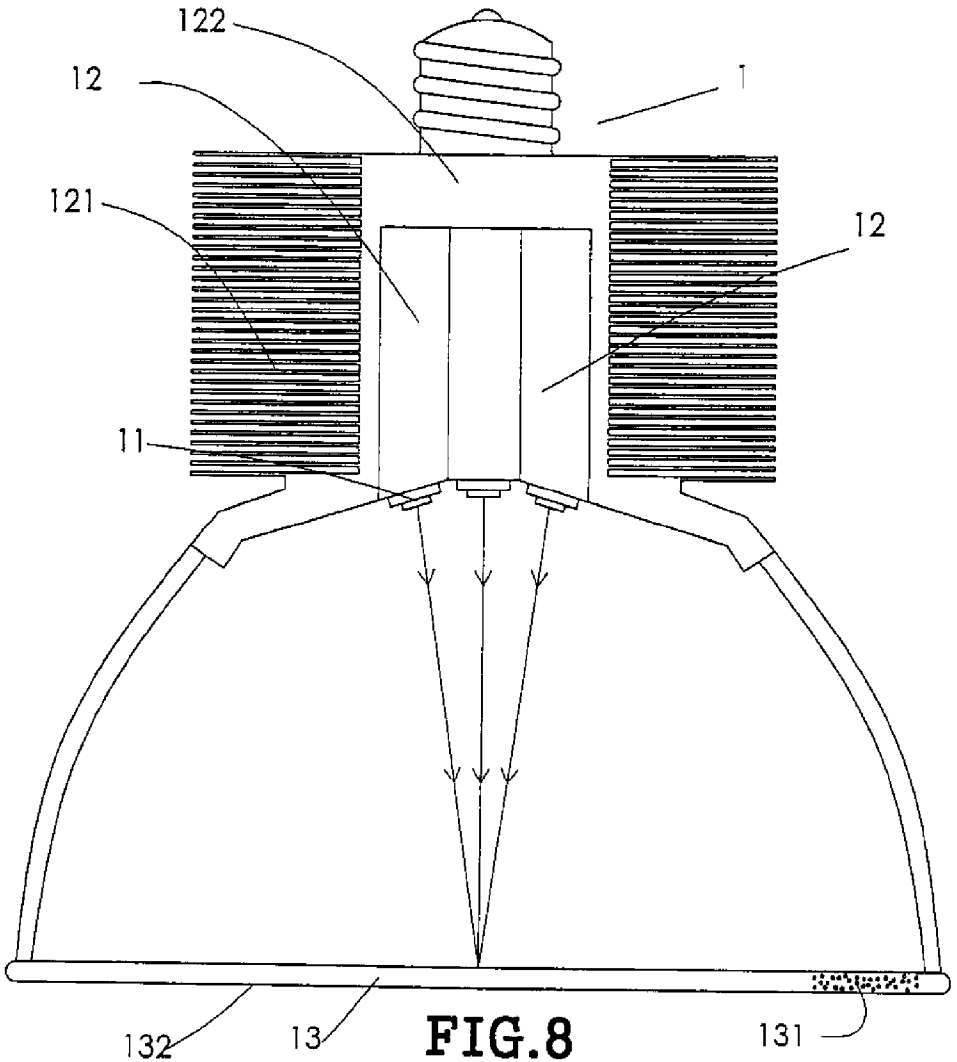
FIG. 8 illustrates a second example application of the present invention.

As shown in FIG. 8, an embodiment showing an application in an embedded lamp is given, which shares the same arrangement as discussed above. However, the lighting device 1 comprises a plurality of heat dissipation elements 12 arranged and mounted within an enhanced heat dissipater 122. By means of a plurality of heat dissipation fins 121 extending from the enhanced heat dissipater 122, the operation of heat removal of the heat dissipation elements 12 can be facilitated. The plurality of light-emitting elements 11 is set at respective angles so that centers of the light beams emitting therefrom intersect at a spot at which the light-transmitting hood 13 is set. Homogenization of light energy can be realized through a structure that employs a material containing diffusive particles 131 or an arrangement of a light diffusion layer 132.

Figure 9:
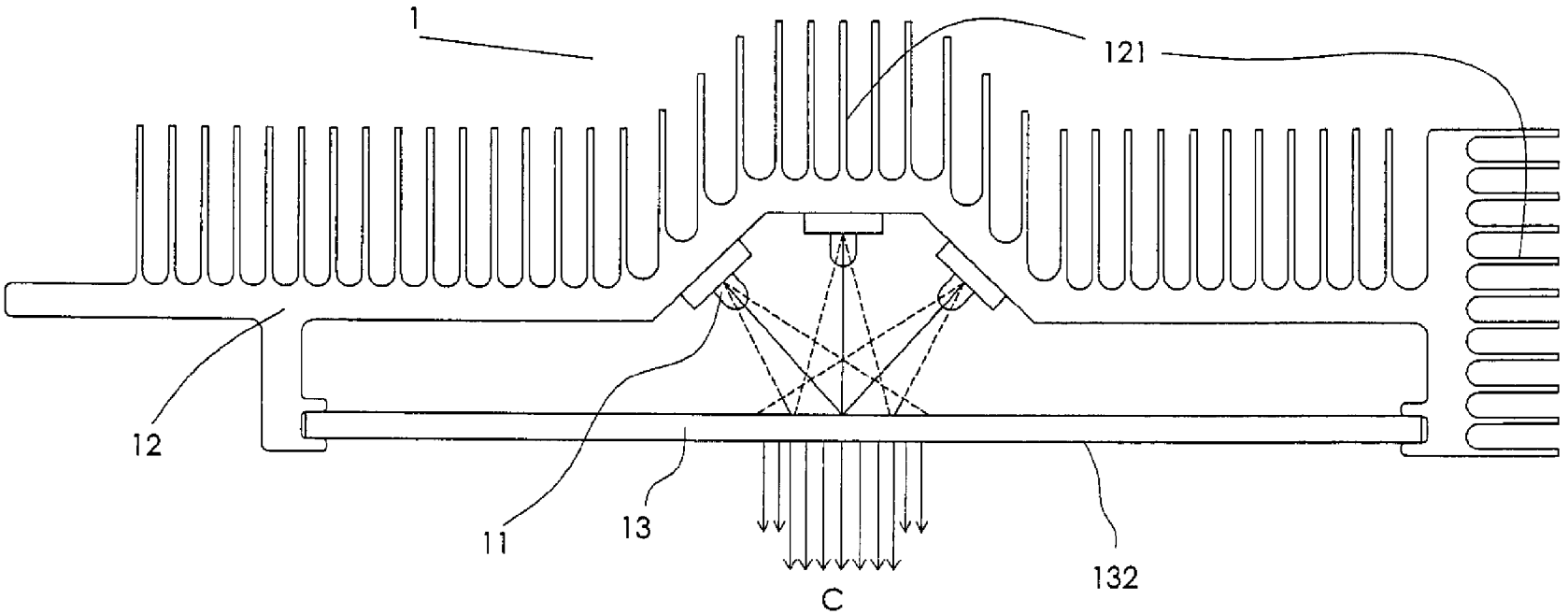
FIG. 9 illustrates a third example application of the present invention.

As shown in FIG. 9, an embodiment showing an application in a desk lamp is given. The lighting device 1 comprises a plurality of light-emitting elements 11 that is mounted to a heat dissipation unit 12 (which comprises heat dissipation fins 121 formed thereon) arranged in a book-reading desk lamp. Light beams from the plurality of light-emitting elements 11 converge at a spot and a light-beam-concentrated light incidence area to radiate at one surface of the light-transmitting hood 13 in a concentrated manner and further projecting outward through another surface that is provided with a light diffusion layer 132 to form a surface-source like light exit area C. With the light beams being first concentrated and then spread off, the light emitting from the lamp is made soft and not over-dazzling, whereby eye harshness and multiple overlap shade that occurs in short-distance reading can be improved.

Figure 10:
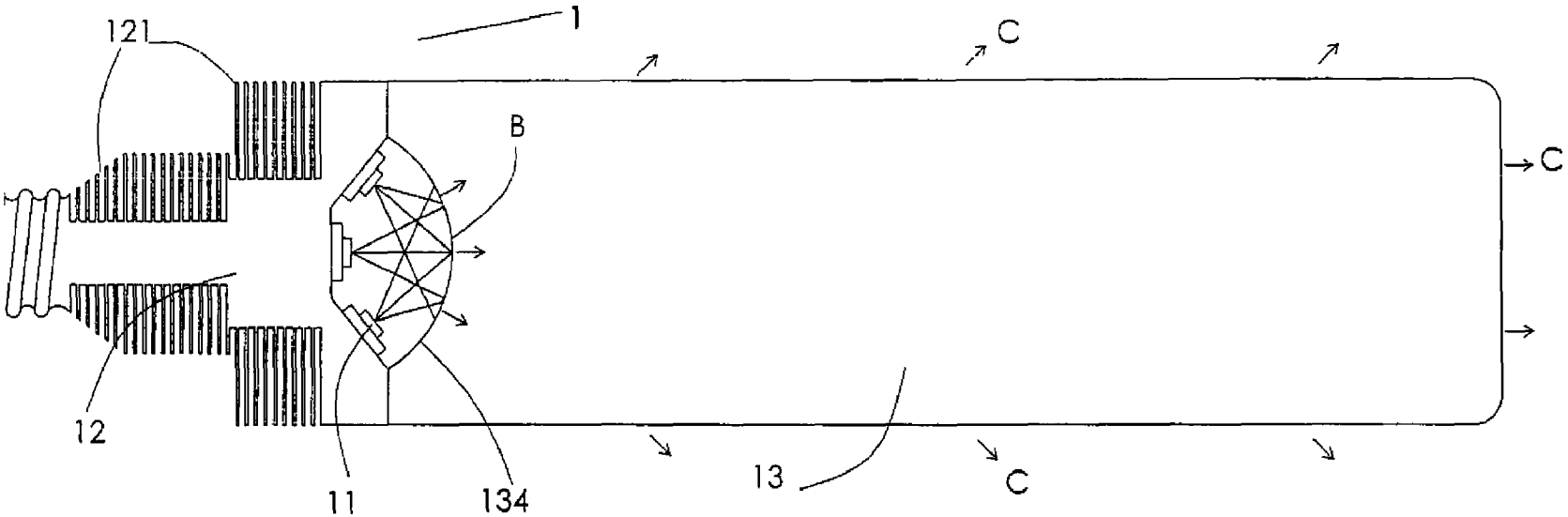
FIG. 10 illustrates a fourth example application of the present invention.

As shown in FIG. 10, an embodiment showing an application in a bar-like lamp is given, which shares the same arrangement as discussed above. The lighting device 1 comprises a plurality of light-emitting elements 11 respectively mounted to the heat dissipation unit 12 and the heat dissipation unit 12 is provided with a plurality of heat dissipation fins 121 to assist hear removal of the heat dissipation unit 12. Through a light incidence area B made in the form of a concave lens 134, light beams emitting from the plurality of light-emitting elements 11 can be uniformly distributed within a broad range. With such a structure, a concentrated, dazzling light beam is softened before projected to the hood, whereby the homogenization of the overall brightness of the light exit area C is made optimum and not so harsh to the eyes.

As discussed above, a plurality of light-emitting element 11 is provided to give off light beams that are convergent at a light incidence area B by which, together with the feature of the light-transmitting hood 13, conversion of multiple light beams into a surface-source like light source can be made for and the concentration of the light can be made to enhance the brightness of the lighting device 1 in an area of application. Further, the lighting device 1 can be applied to any lighting facility.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lighting device comprising:

a plurality of light-emitting elements, which are arranged at different angles inside the lighting device and project light beams that converge at an incidence focusing spot located within a range of the light emitting device and that overlap each other to cover a light incidence area;

an incidence focusing spot, which is formed by the projection of light beams from the plurality of light-emitting elements;

a heat dissipation unit, which comprises a structure forming a plurality of surfaces at different angles with respect to the incidence focusing spot for mounting the plurality of light-emitting elements and functioning to dissipate and transmit heat generated by the light-emitting elements; and a light-transmitting hood, which is set at in front of the light-emitting elements in a direction of light emission and has an inside surface located immediately in front of the incidence focusing spot, a light diffusion layer being formed on an outside light-exit surface or the inside light incident surface of hood to realize light refraction and diffraction and make a light exit area showing an output resembling a surface source.

2. The lighting device according to claim 1, wherein the heat dissipation unit comprises heat dissipation fins.

3. The lighting device according to claim 1, wherein the heat dissipation unit comprises fastening sections.

4. The lighting device according to claim 1, wherein the light-transmitting hood comprises a concave lens corresponding to the light incidence area of the light-emitting element.

5. The lighting device according to claim 1, wherein the light-transmitting hood comprises a convex lens corresponding to the light exit area of the light-emitting element.

6. The lighting device according to claim 1, wherein the light-emitting element comprises a light-emitting diode.

7. The lighting device according to claim 1 wherein the lighting device comprises a plurality of light-emitting elements, which comprise a combination of identical power or different powers.

8. The lighting device according to claim 1 wherein the lighting device comprises a plurality of light-emitting elements, which comprise a combination of identical color temperature or different color temperatures.

* * * * *